United States Patent [19]

Pliefke

[11] Patent Number: 4,482,434

[45] Date of Patent: Nov. 13, 1984

[54] PROCESS FOR ELECTROCHEMICALLY ROUGHENING ALUMINUM FOR PRINTING PLATE SUPPORTS

[75] Inventor: Engelbert Pliefke, Wiesbaden, Fed. Rep. of Germany

[73] Assignee: Hoechst Aktiengesellschaft, Frankfurt am Main, Fed. Rep. of Germany

[21] Appl. No.: 490,568

[22] Filed: May 2, 1983

[30] Foreign Application Priority Data

May 10, 1982 [DE] Fed. Rep. of Germany ..... 3217552

[51] Int. Cl.[3] ..... C25D 5/44; C25D 5/00; C25F 3/04

[52] U.S. Cl. ..... 204/33; 204/38 A; 204/129.4; 204/129.46; 204/129.75; 204/DIG. 9; 204/37.6

[58] Field of Search ..... 204/129.4, DIG. 9, 129.75, 204/33, 35 N, 38 A, 129.46

[56] References Cited

U.S. PATENT DOCUMENTS

| | | | |
|---|---|---|---|
| 3,085,950 | 4/1963 | Thomas et al. | 204/141 |
| 3,193,485 | 7/1965 | Vincent | 204/141 |
| 3,330,743 | 7/1967 | Jestl et al. | 204/33 |
| 3,963,594 | 6/1976 | Brasko | 204/129.95 |
| 4,072,589 | 2/1978 | Golda et al. | 204/129.4 |
| 4,087,341 | 5/1978 | Takahashi et al. | 204/129.43 |
| 4,211,619 | 7/1980 | Usbeck | 204/33 |
| 4,272,342 | 6/1981 | Oda et al. | 204/129.4 |
| 4,276,129 | 6/1981 | Kanzaki et al. | 204/58 |
| 4,279,714 | 7/1981 | Arora et al. | 204/129.9 |
| 4,279,715 | 7/1981 | Arora et al. | 204/129.9 |
| 4,294,672 | 10/1981 | Ohba et al. | 204/129.4 |
| 4,297,184 | 10/1981 | Dyer | 204/129.4 |
| 4,301,229 | 11/1981 | Sakaki et al. | 430/158 |

FOREIGN PATENT DOCUMENTS

| | | |
|---|---|---|
| 885333 | 11/1956 | Fed. Rep. of Germany . |
| 2512244 | 9/1976 | Fed. Rep. of Germany . |
| 879768 | 10/1961 | United Kingdom . |
| 1027695 | 4/1966 | United Kingdom . |
| 1169234 | 10/1969 | United Kingdom . |
| 1400918 | 7/1975 | United Kingdom . |
| 2047274 | 11/1980 | United Kingdom . |

OTHER PUBLICATIONS

Dowell, "The Alternating Current Etching of Aluminium Lithographic Sheet," Transactions of the Inst. of Metal Finishing, 1979, vol. 57, pp. 138–144.

*Primary Examiner*—Donald R. Valentine

*Attorney, Agent, or Firm*—Schwartz, Jeffery, Schwaab, Mack, Blumenthal & Koch

[57] ABSTRACT

Disclosed is a process for electrochemically roughening aluminum or alloys thereof, in an aqueous electrolyte, under the action of an alternating current having a frequency in the range from 0.3 to 15 Hz. The materials roughened in this way are used as supports for radiation-sensitive reproduction coatings in the field of manufacturing offset-printing plates. Also disclosed are roughened aluminum supports and printing plates produced by the above process.

19 Claims, No Drawings

PROCESS FOR ELECTROCHEMICALLY ROUGHENING ALUMINUM FOR PRINTING PLATE SUPPORTS

BACKGROUND OF THE INVENTION

The present invention relates to a process for electrochemically roughening aluminum for use as printing plate supports. In particular, roughening of the aluminum support which is present in an acid and/or salt electrolyte is effected by an alternating current.

Printing plates, used herein to refer to offset-printing plates, usually comprise a support and at least one radiation-sensitive (photosensitive) reproduction coating arranged thereon. The reproduction coating is applied to the support either by the user, in the case of plates which are not pre-coated, or by the industrial manufacturer, in the case of pre-coated plates. Aluminum or an alloy thereof has gained acceptance as a support material in the field of printing plates. In principle, it is possible to use the supports without pretreatment and modification; however, they are generally modified in or on their surfaces, for example, by a mechanical, chemical and/or electrochemical roughening process, sometimes referred to as graining or etching in literature, a chemical or electrochemical oxidation process and/or a treatment with hydrophilizing agents. In modern continuously working high-speed equipment employed by the manufacturers of printing plate supports and/or precoated printing plates, a combination of the aforementioned modifying methods is frequently used, particularly a combination of electrochemical roughening and anodic oxidation, optionally followed by a hydrophilizing step. Roughening is, for example, carried out in aqueous acids, such as aqueous solutions of HCl or $HNO_3$ or in aqueous salt solutions, such as aqueous solutions of NaCl or $Al(NO_3)_3$, using alternating current. The peak-to-valley roughnesses of the roughened surface, which are defined as mean peak-to-valley roughnesses, $R_z$, are in the range from about 1 to 15 $\mu$m, particularly from 2 to 8 $\mu$m. The peak-to-valley roughness is determined according to DIN 4768, October 1970, as the arithmetic mean of the individual peak-to-valley roughness values of five mutually adjacent individual measurement lengths.

Roughening is carried out, inter alia, in order to enhance the adhesion of the reproduction coating to the support and to improve the water acceptance of the printing form, which results from irradiating and developing the printing plate. By irradiating and developing, or decoating in the case of electrophotographically working reproduction coatings, the ink-receptive image areas and the water-retaining non-image areas, the latter generally being the uncovered support surface, are produced on the printing plate in the subsequent printing operation, thus producing the actual printing form. The final topography of the aluminum surface which is to be roughened is influenced by various parameters, as is explained, by way of example, in the text which follows.

The paper, "The Alternating Current Etching of Aluminum Lithographic Sheet", by A. J. Dowell, published in Transactions of the Institute of Metal Finishing, 1979, Vol. 57, pages 138 to 144, presents basic comments on the roughening of aluminum in aqueous solutions of hydrochloric acid, based on variations of the following process parameters and an investigation of the corresponding effects. The electrolyte composition is changed during repeated use of the electrolyte, for example, in view of the $H^+(H_3O^+)$ ion concentration (measurable by means of the pH) and the $Al^{3+}$ ion concentration. As a result of these changes, influences on the surface topography are observed. Temperature variations between 16° C. and 90° C. do not effect changes until temperatures are 50° C. or higher. The effect becoming apparent, for example, as a significant decrease in film formation on the surface. Variations in roughening time between 2 and 25 minutes lead to an increasing metal dissolution with increasing duration of action. Variations in current density between about 2 and 8 A/dm$^2$ result in higher roughness values with rising current density. If the acid concentration is in the range from about 0.17 to 3.3% of HCl, only negligible changes in pit structure occur between about 0.5 and 2% of HCl. Below 0.5% of HCl, the surface is only locally attacked and at the high values, an irregular dissolution of Al takes place. An addition of $SO_4^{2-}$ ions or $Cl^-$ ions in the form of salts, e.g., by adding $Al_2(SO_4)_3$ or NaCl, can also influence the topography of the roughened aluminum. Rectification of the alternating current shows that both half-wave types are necessary to obtain a uniform roughening. The influence of frequency changes or of superpositions of currents of different frequencies are not investigated; a constant frequency of about 50 Hz was utilized.

The influence of the electrolyte composition on the quality of roughening is, for example, also described in the following publications, in which standard alternating current having a frequency from about 50 to 60 Hz is used:

- German Offenlegungsschrift No. 2,250,275 (=British Pat. No. 1,400,918) specifies aqueous solutions containing from 1.0 to 1.5% by weight of $HNO_3$ or from 0.4 to 0.6% by weight of HCl and optionally from 0.4 to 0.6% by weight of $H_3PO_4$, for use as electrolytes in the roughening of aluminum for printing plate supports by means of an alternating current,
- German Offenlegungsschrift No. 2,810,308 (=U.S. Pat. No. 4,072,589) mentions aqueous solutions containing from about 0.2 to 1.0% by weight of HCl and from 0.8 to 6.0% by weight of $HNO_3$ as electrolytes in the roughening of aluminum with alternating current,
- German Auslegeschrift No. 1,238,049 (=U.S. Pat. No. 3,330,743) mentions protective colloids acting as inhibitors, for example, lignin, benzaldehyde, acetophenone or pine needle oil, as additional components in aqueous HNO3 solutions used in the roughening of aluminum for printing plate supports with alternating current,
- U.S. Pat. No. 3,963,594 specifies aqueous solutions containing HCl and gluconic acid as electrolytes in the electrochemical roughening of aluminum for printing plate supports.

Admittedly, the use of aqueous solutions comprising several components to roughen aluminum may lead to more or less uniformly roughened surfaces, but monitoring the bath composition is very expensive, particularly in the case of the presently preferred continuously working high-speed processing equipment for strips. This measure, however, is necessary in practice, since the composition of the electrolyte often changes in the course of the process.

Another known possibility for improving the uniformity of electrochemical roughening comprises a modification of the type of electric current employed, including, for example, using an alternating current, in which the anodic voltage and the anodic coulombic input are higher than the cathodic voltage and the cathodic coulombic input, according to German Auslegeschrift No. 2,650,762 (=U.S. Pat. No. 4,087,341), the anodic half-cycle period of the alternating current being generally adjusted to be less than the cathodic half-cycle period. This method is, for example, also referred to in German Offenlegungsschrift No. 2,912,060 (=U.S. Pat. No. 4,301,229), German Offenlegungsschrift No. 3,012,135 (=published UK patent application No. 2,047,274) or German Offenlegungsschrift No. 3,030,815 (=U.S. Pat. No. 4,272,342), using an alternating current, in which the anodic voltage is markedly increased compared with the cathodic voltage, according to German Offenlegungsschrift No. 1,446,026 (=U.S. Pat. No. 3,193,485), interrupting the current flow for 10 to 120 seconds and re-applying current for 30 to 300 seconds, using alternating current and, as the electrolyte, an aqueous solution of 0.75 to 2.0 N HCl, with the addition of NaCl or $MgCl_2$, according to British Pat. No. 879,768. A similar process comprising an interruption of current flow in the anodic or cathodic phase is also disclosed in German Offenlegungsschrift No. 3,020,420 (=U.S. Pat. No. 4,294,672).

The aforementioned methods may lead to relatively uniformly roughened aluminum surfaces, but each requires a comparatively great equipment expenditure and, in addition, are applicable only within closely limited parameters.

Furthermore, it is also known to adjust the roughening conditions in such a way that frequencies other than 50 to 60 Hz result.

German Pat. No. 885,333 describes an electrochemical treatment of metals under the action of a low-frequency alternating current, as a pretreatment prior to electroplating. It is stated that it is possible to remove scale, annealing residue or rust from metal surfaces, with the aid of this treatment. Acidic solutions are mentioned as the electrolytes and iron as the metal. The frequency employed is specified as being less than 100 Hz, the quality of the surface is referred to as "bright".

German Offenlegungsschrift No. 2,512,244 discloses a process for electrochemically treating steel, in which a direct current having a ripple exceeding 20% and a pulse repetition frequency ranging between 5 and 300 Hz is used. This treatment is intended to improve the abrasion efficiency and smoothing of the surface.

The pulsed direct current according to U.S. Pat. No. 3,085,950 has a frequency in the range from 20 to 6,000 Hz, particularly of about 100 Hz, and a pulse duration in the range from 5 to 100 $\mu$ seconds, particularly of about 20 $\mu$ seconds. In the intervals between pulses, the current falls to 0. This treatment leads to a roughening of the surfaces of aluminum foils of a kind used in electrolytic capacitors.

U.S. Pat. Nos. 4,279,714 and No. 4,279,715 describe the roughening of aluminum for the field of electrolytic capacitors, in which an alternating current of a frequency in the range from 20 to 60 Hz is used. The topography of capacitor foils having needle-shaped pits which are deep relative to their width, is basically different from the topography of an aluminum foil suitable for use as a printing plate support, having semi-spherical, interlinking pits which are similarly dimensioned in respect to depth and width and are distributed, as uniformly as possible, over the surface. As can be seen from the comparative examples hereinafter described, the surfaces which are obtainable at 20 Hz and higher frequencies are, however, noticeably less uniformly roughened than those obtainable with lower frequencies.

The processes which are known from the treatment of metals, for example, iron or steel, are intended to lead to a smoothing of the surface, i.e. a process opposite a roughening process. The processes known from the roughening of aluminum do not result in a uniform topography, as shown above.

SUMMARY OF THE INVENTION

It is therefore an object of the present invention to provide a process for electrochemically roughening aluminum, which is carried out using an alternating current and which leads to a roughening structure of a uniformity such that the aluminum can be used as a printing plate support.

It is another object of the present invention to provide a process for producing a printing plate having a uniformly roughened aluminum support.

In accomplishing the foregoing objects, there has been provided in accordance with one aspect of the present invention a process for electrochemically roughening aluminum or alloys thereof for use as printing plate supports, comprising the step of electrochemically roughening aluminum or an aluminum alloy in an aqueous electrolyte with an alternating current having a frequency in the range from about 0.3 to 15 Hz. Preferably, the frequency ranges from about 0.8 to 15 Hz. More preferably, the frequency ranges from about 1.5 to 10 Hz.

In accordance with another aspect of the present invention, there has been provided a roughened aluminum support produced by the above-mentioned process.

In accordance with still another aspect of the present invention, there has been provided a process for producing printing plates, comprising the steps of providing an aluminum or aluminum alloy support, contacting the support with an aqueous electrolyte, applying to the support an alternating current having a frequency from about 0.3 to 15 Hz to produce a roughened aluminum support, and coating the roughened support with a radiation-sensitive reproduction coating.

In accordance with yet another aspect of the present invention, there has been provided a printing plate produced by the above-mentioned process.

As evidenced in the examples which are described below, the application of an alternating current which has a frequency in the lowest region of the specified range, for example, at about 0.5 Hz and below, may produce a surface topography which is less suitable for printing plates; however, good and even very good results are also possible. It is assumed that, in the case of these very low frequencies, an increased formation of a whitish deposit ("smut") which can be removed by means of dilute acids or bases upon completion of the roughening step, could cause a certain irregularity in the roughening. The occurrence of this deposit can possibly be reduced or even suppressed by setting up a particular flow between the electrolyte and the aluminum surface.

Further objects, features and advantages of the present invention will become apparent from the detailed description of preferred embodiments which follows.

DETAILED DESCRIPTION OF PREFERRED EMBODIMENTS

The process of the invention can be carried out either continuously or discontinuously; however, a continuous process is preferred. The process utilizes strips of aluminum or aluminum alloys. In continuous processes, the process parameters during roughening are generally within the following ranges: temperature of the electrolyte between about 20° and 60° C., electrolyte (acid and/or salt) concentration between about 1 and 250 g/l, particularly between about 5 and 100 g/l, current density between about 3 and 130 A/dm$^2$, dwell time of a material spot to be roughened in the electrolyte between about 10 and 300 seconds, and rate of flow of the electrolyte on the surface of the material to be roughened between about 5 and 100 cm/second. The type of alternating current used can, for example, have a rectangular, trapezoidal or sinusoidal shape, the rectangular shape being preferred in the process according to the invention. In discontinuous processes, the required current densities are in the lower region and the dwell times in the upper region of the ranges indicated in each case. Additionally, a flow of the electrolyte can even be dispensed with in these processes. In addition to the electrolytes, for example, aqueous solutions of HCl and/or $HNO_3$, which have been previously mentioned, it is also possible to use aqueous salt solutions, for example, as described in German Pat. No. 2,537,724 (=British Pat. No. 1,532,303) or in German Pat. No. 2,527,725 (=U.S. Pat. No. 4,166,015). Suitable apparatus for the continuous performance of the process according to the invention are, for example, disclosed in German Pat. No. 2,234,365 (=U.S. Pat. No. 3,880,744) or in German Pat. No. 2,234,424 (=U.S. Pat. No. 3,871,982).

The following materials which may be in the form of a sheet, a foil or a strip and which were employed in the examples which follow are, for example, used for roughening in the process of the invention:

"Pure aluminum" (DIN Material No. 3.0255), i.e., composed of not less than 99.5% Al, and the following permissible admixtures (maximum total 0.5%) of 0.3% Si, 0.4% Fe, 0.03% Ti, 0.02% Cu, 0.07% Zn and 0.03% of other substances, or "Al-alloy 3003" (comparable to DIN Material No. 3.0515), i.e, composed of not less than 98.5% Al, 0 to 0.3% Mg and 0.8 to 1.5% Mn, as alloying constituents, and 0.5% Si, 0.5% Fe, 0.2% Ti, 0.2% Zn, 0.1% Cu and 0.15% of other substances, as permissible admixtures.

The electrochemical roughening process according to the present invention may be followed by an anodic oxidation of the aluminum in a further process step, in order to improve, for example, the abrasive and adhesive properties of the surface of the support material. Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. The following are standard methods for the use of aqueous, $H_2SO_4$-containing electrolytes for the anodic oxidation of aluminum (see, in this regard, e.g. M. Schenk, Werkstoff Aluminium und seine anodische Oxydation (The Material Aluminum and its Anodic Oxidation), Francke Verlag, Bern, 1948, page 760; Praktische Galvanotechnik (Practical Electroplating), Eugen G. Leuze Verlag, Saulgau, 1970, pages 395 et seq., and pages 518/519; W. Huebner and C. T. Speiser, Die Praxis der anodischen Oxidation des Aluminiums (Practical Technology of the Anodic Oxidation of Aluminum), Aluminium Verlag, Duesseldorf, 1977, 3rd Edition, pages 137 et seq.):

The direct current sulfuric acid process refers to a process in which anodic oxidation is carried out in an aqueous electrolyte which conventionally contains approximately 230 g of $H_2SO_4$ per 1 liter of solution, for 10 to 60 minutes at 10° to 22° C., and at a current density of 0.5 to 2.5 A/dm$^2$. In this process, the sulfuric acid concentration in the aqueous electrolyte solution can also be reduced to 8 to 10% by weight of $H_2SO_4$ (about 100 g of $H_2SO_4$ per liter), or it can also be increased to 30% by weight (365 g of $H_2SO_4$ per liter), or more.

The "hard-anodizing process" is carried out using an aqueous electrolyte, containing $H_2SO_4$ in a concentration of 166 g of $H_2SO_4$ per liter (or about 230 g of $H_2SO_4$ per liter), at an operating temperature of 0 ° to 5° C., and at a current density of 2 to 3 A/dm$^2$, for 30 to 200 minutes, at a voltage which rises from approximately 25 to 30 V at the beginning of the treatment, to approximately 40 to 100 V toward the end of the treatment.

In addition to the processes for the anodic oxidation of printing plate support materials which have already been mentioned in the preceding paragraph, the following processes can, for example, also be used: the anodic oxidation of aluminum in an aqueous, $H_2SO_4$-containing electrolyte, in which the content of $Al^{3+}$ ions is adjusted to values exceeding 12 g/l (according to German Offenlegungsschrift No. 2,811,396=U.S. Pat. No. 4,211,619), in an aqueous electrolyte containing $H_2SO_4$ and $H_3PO_4$ (according to German Offenlegungsschrift No. 2,707,810=U.S. Pat. No. 4,049,504), or in an aqueous electrolyte containing $H_2SO_4$, $H_3PO_4$ and $Al^{3+}$ ions (according to German Offenlegungsschrift No. 2,836,803=U.S. Pat. No. 4,229,226). Direct current is preferably used for the anodic oxidation, but it is also possible to use alternating current or a combination of these types of current (for example, direct current with superimposed alternating current). The layer weights of aluminum oxide range from about 1 to 10 g/m$^2$, which corresponds to layer thicknesses from about 0.3 to 3.0 $\mu$m. After the electrochemical roughening step and prior to an anodic oxidation step, an abrasive modification of the roughened surface may additionally be performed, as described, for example, in German Offenlegungsschrift No. 3,009,103. A modifying intermediate treatment of this kind can, inter alia, enable the formation of abrasion-resistant oxide layers and reduce the tendency to scumming in the subsequent printing operation.

The anodic oxidation of the aluminum support material for printing plates is optionally followed by one or more post-treating steps. Post-treating is particularly understood to be a hydrophilizing chemical or electrochemical treatment of the aluminum oxide layer, for example, an immersion treatment of the material in an aqueous solution of polyvinyl phosphonic acid according to German Pat. No. 1,621,478 (=British Pat. No. 1,230,447), an immersion treatment in an aqueous solution of an alkali-metal silicate according to German Auslegeschrift No. 1,471,707 (=U.S. Pat. No.

3,181,461), or an electrochemical treatment (anodization) in an aqueous solution of an alkali-metal silicate according to German Offenlegungsschrift No. 2,532,769 (=U.S. Pat. No. 3,902,976). These post-treatment steps serve, in particular, to even further improve the hydrophilic properties of the aluminum oxide layer, which are already sufficient for many fields of application, while maintaining the other well-known properties of the layer.

Suitable photosensitive reproduction coatings basically comprise any coatings which, after exposure, optionally followed by development and/or fixing, yield a surface in image configuration, which can be used for printing and/or which represents a relief image of an original. The coatings are applied to one of the support materials roughened according to the present invention, either by the manufacturers of presensitized printing plates or so-called dry resists or directly by the user. The photosensitive reproduction coatings include those which are described, for example, in "Light-Sensitive Systems", by Jaromir Kosar, published by John Wiley & Sons, New York, 1965. These include coatings containing unsaturated compounds, which, upon exposure, are isomerized, rearranged, cyclized, or cross-linked (Kosar, Chapter 4); coatings containing compounds, e.g. monomers or prepolymers, which can be photopolymerized, which, on being exposed, undergo polymerization, optionally with the aid of an initiator (Kosar, Chapter 5); and coatings containing o-diazoquinones, such as naphthoquinone-diazides, p-diazoquinones, or condensation products of diazonium salts (Kosar, Chapter 7).

Other suitable coatings include the electrophotographic coatings, i.e. coatings which contain an inorganic or organic photoconductor. In addition to the photosensitive substances, these coatings can, of course, also contain other constituents, such as for example, resins, dyes, pigments, wetting agents, sensitizers, adhesion promoters, indicators, plasticizers or other conventional auxiliary agents. In particular, the following photosensitive compositions or compounds can be employed in the coating of support materials:

positive-working o-quinone diazide compounds, preferably o-naphthoquinone diazide compounds, which are described, for example, in German Pat. Nos. 854,890, 865,109, 879,203, 894,959, 938,233, 1,109,521, 1,144,705, 1,118,606 1,120,273 and 1,124,817;

negative-working condensation products from aromatic diazonium salts and compounds with active carbonyl groups, preferably condensation products formed from diphenylaminediazonium salts and formaldehyde, which are described, for example, in German Pat. Nos. 596,731, 1,138,399, 1,138,400, 1,138,401, 1,142,871, and 1,154,123, U.S. Pat. Nos. 2,679,498 and 3,050,502 and British Pat. No. 712,606;

negative-working co-condensation products of aromatic diazonium compounds, for example, according to German Offenlegungsschrift No. 2,024,244, which possess, in each case, at least one unit of the general types $A(-D)_n$ and B, connected by a divalent linking member derived from a carbonyl compound which is capable of participating in a condensation reaction. In this context, these symbols are defined as follows: A is the radical of a compound which contains at least two aromatic carbocyclic and/or heterocyclic nuclei, and which is capable, in an acid medium, of participating in a condensation reaction with an active carbonyl compound, at one or more positions. D is a diazonium salt group which is bonded to an aromatic carbon atom of A; n is an integer from 1 to 10, and B is the radical of a compound which contains no diazonium groups and which is capable, in an acid medium, of participating in a condensation reaction with an active carbonyl compound, at one or more positions on the molecule;

positive-working coatings according to German Offenlegungsschrift No. 2,610,842, which contain a compound which, on being irradiated, splits off an acid, a compound which possesses at least one C—O—C group, which can be split off by acid (e.g., an orthocarboxylic acid ester group, or a carboxamide-acetal group), and, if appropriate, a binder;

negative-working coatings, composed of photopolymerizable monomers, photo-initiators, binders and, if appropriate, further additives. In these coatings, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschrift Nos. 2,064,079 and 2,361,041. Suitable photo-initiators are, inter alia, benzoin, benzoin ethers, polynuclear quinones, acridine derivatives, phenazine derivatives, quinoxaline derivatives, quinazoline derivatives, or synergistic mixtures of various ketones. A large number of soluble organic polymers can be employed as binders, for example, polyamides, polyesters, alkyd resins, polyvinyl alcohol, polyvinyl-pyrrolidone, polyethylene oxide, gelatin or cellulose ethers;

negative-working coatings according to German Offenlegungsschrift No. 3,036,077, which contain, as the photosensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photosemiconducting coatings to the support materials, such as described, for example, in German Pat. Nos. 1,117,391, 1,522,497, 1,572,312, 2,322,046 and 2,322,047, as a result of which highly photosensitive electrophotographic coatings are produced.

The materials for printing plate supports, which have been roughened according to the process of the invention, exhibit a uniform topography, which positively influences the stability of print runs and the water acceptance during printing with printing forms manufactured from these supports. Compared with the use of alternating current of higher frequencies, e.g. 20 Hz or more, "pitting" (pronounced depressions, in comparison to the surrounding roughening) occurs less frequently and can even be completely suppressed. These surface characteristics can be produced without great equipment expenditure and without continuously monitoring the quality and quantity of the bath. The surface of aluminum which has been roughened according to the process of the present invention is even considerably lighter than the surface of aluminum which has been roughened at higher frequencies, so that a clearer contrast is obtainable upon exposure and after development. Possibly, the positive influence on the topography can be ascribed to an improved transport of matter at the interface between aluminum and the electrolyte.

The present invention is explained in further detail by the following non-limiting examples wherein percentages denote percentages by weight, unless otherwise stated. Parts by weight are related to parts by volume as the g is related to the $cm^3$.

EXAMPLES 1 TO 37 AND COMPARATIVE EXAMPLES C1 TO C37

In the examples and comparative examples which follow, a rectangular alternating current was employed throughout, with the exception of Examples 9, C9, 14, C14, 18, C18, 26 and C26, in which a sinusoidal alternating current was used. The examples carried out at frequencies of 50 and 500 Hz serve as comparative examples to illustrate the improvement of the surface quality by the application of frequencies lower than these values. In electrolytes containing hydrochloric acid, a black deposit which could not be wiped off and was relatively sparingly soluble, additionally occurred at 50 Hz and current densities exceeding 20 $A/dm^2$, this deposit was not observed at lower frequencies.

An aluminum sheet was first pickled in an aqueous solution containing 20 g/l of NaOH, at room temperature, for a duration of 60 seconds, and was then freed from any alkaline residue which may have been present, by briefly dipping into a solution corresponding to the electrolyte used for roughening. Roughening was carried out in the specified electrolytes, either with galvanostatic or potentiostatic control, in the latter case, the reference electrode was the saturated Ag/AgCl system. Examples 1 to 33 and C1 to C33 were galvanostatically controlled (Table I) and Examples 34 to 37 and C34 to C37 (Table II) were potentiostatically controlled.

Classification into quality grades (surface topography) was made by visual assessment under a microscope, a homogeneously roughened surface which was free from pitting was assigned quality grade "1". A surface with severe pitting of a size exceeding 100 μm or with an extremely nonuniformly roughened surface was assigned quality grade "10". The electrolytes used in the examples had the following compositions:

Electrolyte A: 1.0 part by weight of $HNO_3$ and 5.0 parts by weight of $Al(NO_3)_3.9\ H_2O$ per 100 parts by volume of aqueous solution;

Electrolyte B: 1.5 parts by weight of $HNO_3$ and 7.0 parts by weight of $Al(NO_3)_3.9\ H_2O$ per 100 parts by volume of aqueous solution;

Electrolyte C: 2.0 parts by weight of $HNO_3$ and 9.0 parts by weight of $Al(NO_3)_3.9\ H_2O$ per 100 parts by volume of aqueous solution;

Electrolyte D: 3% strength aqueous soluton of HCl; and

Electrolyte E: 5% strength aqueous solution of HCl.

Electrolysis was started with the electrolyte being at room temperature. As a comparison, Examples 16 and 28 were additionally carried out at 20 Hz (C16 and C28) with surface qualities of 7 and 6, respectively, being obtained.

TABLE I

| Example or Comparative Example, resp. | Electrolyte | Time of Electrolysis (seconds) | Current Density ($A/dm^2$) | Surface Quality at a Frequency (Hz) 0.5 | 5 | 50 | 500 |
|---|---|---|---|---|---|---|---|
| 1/C1 | B | 180 | 12 | 3 | 1 | 4 | 8 |
| 2/C2 | A | 180 | 12 | 3 | 3 | 9 | 7 |
| 3/C3 | C | 180 | 12 | 3 | 1 | 2 | 8 |
| 4/C4 | D | 180 | 12 | 10 | 2 | 7 | 8 |
| 5/C5 | B | 60 | 16 | 3 | 2 | 4 | 7 |
| 6/C6 | A | 120 | 16 | 8 | 2 | 7 | 6 |
| 7/C7 | D | 120 | 16 | 10 | 4 | 7 | 6 |

TABLE I-continued

| Example or Comparative Example, resp. | Electrolyte | Time of Electrolysis (seconds) | Current Density ($A/dm^2$) | Surface Quality at a Frequency (Hz) 0.5 | 5 | 50 | 500 |
|---|---|---|---|---|---|---|---|
| 8/C8 | E | 120 | 16 | 9 | 4 | 8 | 10 |
| 9/C9 | B | 200 | 16 | 3 | 2 | 6 | 7 |
| 10/C10 | B | 45 | 20 | 8 | 3 | 6 | 7 |
| 11/C11 | A | 90 | 20 | 9 | 4 | 8 | 6 |
| 12/C12 | D | 90 | 20 | 9 | 4 | 8 | 5 |
| 13/C13 | E | 90 | 20 | 9 | 3 | 6 | 10 |
| 14/C14 | B | 200 | 20 | 3 | 2 | 6 | 7 |
| 15/C15 | B | 45 | 24 | 2 | 2 | 7 | 7 |
| 16/C16 | B | 60 | 24 | 4 | 2 | 8 | 7 |
| 17/C17 | C | 60 | 24 | 2 | 4 | 7 | 6 |
| 18/C18 | B | 150 | 24 | 9 | 4 | 9 | 6 |
| 19/C19 | B | 30 | 28 | 4 | 3 | 7 | 6 |
| 20/C20 | B | 40 | 28 | 8 | 2 | 8 | 6 |
| 21/C21 | B | 50 | 28 | 5 | 2 | 8 | 6 |
| 22/C22 | B | 60 | 28 | 7 | 1 | 8 | 6 |
| 23/C23 | C | 60 | 28 | 6 | 2 | 8 | 7 |
| 24/C24 | D | 60 | 28 | 9 | 3 | 6 | 5 |
| 25/C25 | E | 60 | 28 | 9 | 3 | 7 | 10 |
| 26/C26 | B | 150 | 28 | 10 | 5 | 8 | 6 |
| 27/C27 | B | 30 | 32 | 4 | 1 | 6 | 6 |
| 28/C28 | B | 50 | 32 | 5 | 1 | 8 | 7 |
| 29/C29 | E | 50 | 32 | 10 | 3 | 7 | 7 |
| 30/C30 | C | 50 | 32 | 5 | 2 | 8 | 7 |
| 31/C31 | B | 40 | 36 | 5 | 2 | 6 | 6 |
| 32/C32 | C | 40 | 36 | 5 | 2 | 7 | 8 |
| 33/C33 | B | 50 | 36 | 6 | 2 | 8 | 7 |

TABLE II

| Example or Comparative Example, resp. | Electrolyte | Time of Electrolysis (seconds) | Voltage (V) | Surface Quality at a Frequency of (Hz) 0.5 | 5 | 50 | 500 |
|---|---|---|---|---|---|---|---|
| 34/C34 | C | 45 | 5 | 3 | 2 | 7 | 10 |
| 35/C35 | C | 90 | 5 | 4 | 1 | 6 | 9 |
| 36/C36 | C | 30 | 7 | 2 | 3 | 5 | 6 |
| 37/C37 | C | 60 | 7 | 6 | 2 | 4 | 5 |

EXAMPLE 38

An aluminum sheet which had been roughened at 5 Hz in accordance with Example 22 was anodically oxidized in an electrolyte comprising $H_2SO_4$ and $Al_2(SO_4)_3$, as specified in German Offenlegungsschrift No. 2,811,396, until a 2.8 μm thick oxide layer was obtained. The roughened and anodically oxidized aluminum support was then coated with the following negative-working photosensitive coating.

0.70 part by weight of the polycondensation product of 1 mole of 3-methoxy-diphenylamine-4-diazonium sulfate and 1 mole of 4,4'-bis-methoxymethyl-diphenyl ether, precipitated as the mesitylene sulfonate, 3.40 parts by weight of 85% strength $H_3PO_4$, 3.00 parts by weight of a modified epoxide resin, obtained by reacting 50 parts by weight of an epoxide resin having a molecular weight of less than 1,000 and 12.8 parts by weight of benzoic acid in ethylene glycol monomethyl ether, in the presence of benzyltrimethylammonium hydroxide, 0.44 part by weight of finely-ground Heliogen Blue G (C.I. 74 100), 62.00 parts by volume of ethylene glycol monomethyl ether, 30.60 parts by volume of tetrahydrofuran, and 8.00 parts by volume of butyl acetate.

After imagewise exposure, the coating was developed with a solution of 2.80 parts by weight of $Na_2SO_4.10H_2O$, 2.80 parts by weight of $MgSO_4.7H_2O$,
0.90 part by weight of 85% strength $H_3PO_4$,
0.08 part by weight of $H_3PO_3$,
1.60 parts by weight of a non-ionic wetting agent,
10.00 parts by weight of benzyl alcohol,
20.00 parts by weight of n-propanol, and
60.00 parts by weight of water.

It was possible to print 125,000 copies from this printing form.

EXAMPLE 39

A printing plate which was anodically oxidized and coated as specified in Example 38, but which was roughened at 0.5 Hz, upon development, resulted in a printing form which yielded a print run of 95,000 copies.

COMPARATIVE EXAMPLE C38

A printing plate which was anodically oxidized and coated as specified in Example 38, but which was roughened at 50 Hz, upon development, resulted in a printing form, which yielded a print run of only 40,000 copies.

What is claimed is:

1. A process for producing a printing plate, comprising the steps of electrochemically roughening an aluminum or an aluminum alloy support in an aqueous electrolyte with an alternating current having a frequency in the range from about 1.5 to 10 Hz, and coating said roughened support with a radiation-sensitive reproduction coating.

2. A process as claimed in claim 1, wherein said alternating current comprises a rectangular shape.

3. A process as claimed in claim 1, wherein said aqueous electrolyte solution comprises HCl.

4. A process as claimed in claim 1, wherein said aqueous electrolyte solution comprises $HNO_3$.

5. A process as claimed in claim 1, wherein said process is continuously performed.

6. A process as claimed in claim 1, wherein said process is discontinuously performed.

7. A process as claimed in claim 1, further comprising the step of anodically oxidizing said aluminum support to produce an aluminum oxide layer prior to said coating step.

8. A process as claimed in claim 7, further comprising the step of abrasively modifying said roughened surface prior to said anodically oxidizing step.

9. A process as claimed in claim 7, further comprising the step of post-treating said support prior to said coating step.

10. A process as claimed in claim 9, wherein said post-treating step comprises a hydrophilizing treatment of said aluminum oxide layer.

11. A process as claimed in claim 10, wherein said hydrophilizing treatment comprises a chemical treatment.

12. A process as claimed in claim 10, wherein said hydrophilizing treatment comprises an electrochemical treatment.

13. A process as claimed in claim 1, wherein the temperature of said electrolyte ranges from about 20° to 60° C.

14. A process as claimed in claim 1, wherein the concentration of said electrolyte ranges from about 1 to 250 g/l.

15. A process as claimed in claim 1, wherein said support is uniformly roughened.

16. A roughened aluminum support produced by the process defined by claim 1.

17. A process for producing printing plates, comprising the steps of:

providing an aluminum or aluminum alloy support;
contacting said support with an aqueous electrolyte;
applying to said support an alternating current having a frequency from about 1.5 to 10 Hz to produce a roughened aluminum support; and
coating said roughened support with a radiation-sensitive reproduction coating.

18. A printing plate produced by the process defined by claim 17.

19. A process for producing printing plate supports based on aluminum or alloys thereof, comprising the steps of:

electrochemically roughening aluminum or an aluminum alloy support in an aqueous electrolyte with an alternating current having a frequency in the range from about 1.5 to 10 Hz and a rectangular, trapezoidal or sinusoidal shape; and
coating said roughened support with a radiation-sensitive reproduction coating.

* * * * *